US008567497B2

(12) United States Patent
Moen et al.

(10) Patent No.: US 8,567,497 B2
(45) Date of Patent: Oct. 29, 2013

(54) APPARATUS AND METHODS FOR INSERTING AND REMOVING TRACER MATERIALS IN DOWNHOLE SCREENS

(75) Inventors: Terje Moen, Sandnes (NO); Ezio Toffanin, Stavanger (NO); Timo Jokela, Stavanger (NO); Tage Thorkildsen, Raege (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 497 days.

(21) Appl. No.: 12/832,735

(22) Filed: Jul. 8, 2010

(65) Prior Publication Data

US 2011/0024111 A1 Feb. 3, 2011

Related U.S. Application Data

(60) Provisional application No. 61/224,678, filed on Jul. 10, 2009.

(51) Int. Cl.
*E21B 47/00* (2012.01)

(52) U.S. Cl.
USPC ..... 166/252.6

(58) Field of Classification Search
USPC ..... 166/252.6
See application file for complete search history.

(56) References Cited

U.S. PATENT DOCUMENTS

| | | | | |
|---|---|---|---|---|
| 3,199,596 | A | 8/1965 | Wood | |
| 5,892,147 | A | 4/1999 | Garnes et al. | |
| 6,645,769 | B2 | 11/2003 | Tayebi et al. | |
| 6,672,385 | B2 | 1/2004 | Kilaas et al. | |
| 6,837,308 | B2 * | 1/2005 | Michel | 166/51 |
| 6,840,316 | B2 | 1/2005 | Stegemeier et al. | |
| 7,347,260 | B2 * | 3/2008 | Ferguson et al. | 166/250.12 |
| 7,473,672 | B2 | 1/2009 | Kotlar et al. | |
| 2001/0036667 | A1 * | 11/2001 | Tayebi et al. | 436/56 |
| 2004/0020832 | A1 * | 2/2004 | Richards et al. | 210/106 |
| 2004/0084186 | A1 | 5/2004 | Allison | |
| 2004/0108107 | A1 | 6/2004 | Wittrisch | |
| 2004/0134655 | A1 | 7/2004 | Richards | |
| 2006/0131033 | A1 * | 6/2006 | Bode et al. | 166/386 |
| 2009/0008078 | A1 * | 1/2009 | Patel | 166/50 |
| 2009/0133882 | A1 * | 5/2009 | Delaloye et al. | 166/377 |

FOREIGN PATENT DOCUMENTS

| | | | |
|---|---|---|---|
| EP | 1301686 | B1 | 4/2005 |
| EP | 1277051 | B1 | 8/2006 |
| EP | 1744137 | B1 | 11/2010 |
| WO | 0181914 | A1 | 11/2001 |
| WO | 2006004426 | A1 | 1/2006 |

* cited by examiner

*Primary Examiner* — Jennifer H Gay
*Assistant Examiner* — Kipp Wallace
(74) *Attorney, Agent, or Firm* — David G. Matthews; Brandon Clark; Robb D. Edmonds

(57) ABSTRACT

A downhole screen assembly for dispensing a tracer material and methods for using the same are provided. The downhole screen assembly can include a body having a screen disposed thereabout. The downhole screen assembly can also include chamber proximate the screen. The downhole screen assembly can further include a first member disposed about the body. The first member can have a port in fluid communication with the chamber. The downhole screen assembly can further include a second member at least partially disposed on the first member. The second member can be removable and can seal the port.

20 Claims, 7 Drawing Sheets

APPARATUS AND METHODS FOR INSERTING AND REMOVING TRACER MATERIALS IN DOWNHOLE SCREENS

CROSS-REFERENCE TO RELATED APPLICATIONS

This application claims priority of a provisional application No. 61/224,678, filed on Jul. 10, 2009, the disclosure of which is incorporated by reference in its entirety.

BACKGROUND

Tracers or tracer materials have been used in the oil industry as a way to identify treatment fluid paths. More recently, tracer materials have been used to identify produced fluid. Particularly, tracers or tracer materials have been placed on screen joints at the sand face to gather data on the produced fluid.

Tracer materials are installed in screens by various methods. For example, the tracer material can be installed as a solid during the manufacturing process of the screen. In this method, the tracer material is installed before the end rings are welded to the wire-wrapped jackets of the screen. Another method, used post-manufacturing, can be to inject the tracer material into the screen in a liquid form. This particular method requires specialized equipment to inject and "cure" a tracer matrix into the screen. Such methods have considerable disadvantages and limitations for usage of tracers in field applications.

There is a need, therefore, for an improved tracer installation apparatus and methods for using the same.

SUMMARY

A downhole screen assembly for dispensing a tracer material and methods for using the same are provided. The downhole screen assembly can include a body having a screen disposed thereabout. The downhole screen assembly can also include a chamber proximate the screen. The downhole screen assembly can further include a first member disposed about the body. The first member can have a port in fluid communication with the chamber. The downhole screen assembly can further include a second member at least partially disposed on the first member. The second member can be removable and can seal the port.

The method of installing tracer material in sand screens can include accessing a downhole screen assembly. The downhole screen assembly can include a body having a screen disposed thereabout. The downhole screen assembly can also include a chamber proximate the screen. The downhole screen assembly can further include a first member disposed about the body. The first member can have a port in fluid communication with the chamber. The downhole screen assembly can further include a second member at least partially disposed on the first member. The second member can be removable and can seal the port. The method can further include removing the second member, inserting tracer material through the port into the chamber, and sealing the port by reattaching the second member.

The downhole screen assembly can include a body having a screen disposed thereabout. The downhole screen assembly can also include a housing disposed on the body. The housing can have an annulus disposed therein. The annulus can be in fluid communication with the screen. The downhole screen assembly can further include a chamber disposed in the housing. An access port can be disposed in a first member of the housing between the chamber and the annulus. The access port can be in fluid communication with the annulus and the chamber.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1A:
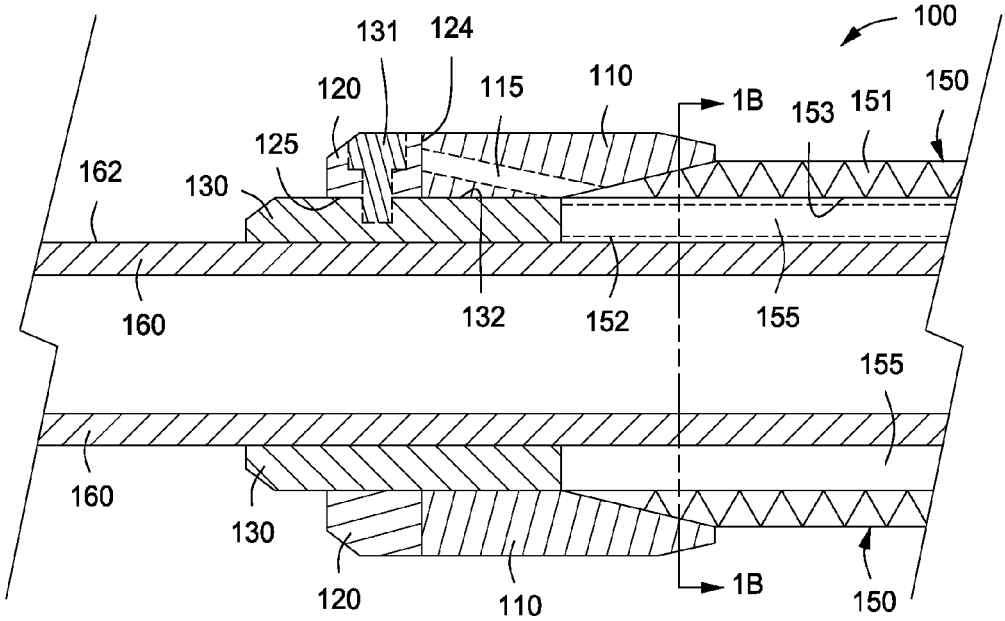
FIG. 1A depicts a cross-sectional view of an illustrative downhole screen assembly for dispensing a tracer material, according to one or more embodiments described.

FIG. 1A depicts a cross-sectional view of an illustrative downhole screen assembly 100 for dispensing a tracer material, according to one or more embodiments. The downhole screen assembly 100 can include a body or mandrel 160 having a screen 150 disposed thereabout. A first member or "inner member" 130 can also be disposed about the body 160, adjacent one end of the screen 150 to define a chamber 155 between an inner diameter or inner surface 153 of the screen 150 and an outer diameter or outer surface 162 of the body 160. A second member or "injection member" 110 having one or more ports 115 disposed therethrough can be at least partially disposed about the inner member 130 and/or the screen 150. The port(s) 115 can be in fluid communication with the chamber 155, allowing a tracer material or other fluid to be injected or placed within the chamber 155, as discussed in more detail below.

The inner member 130 can be threadably fastened or otherwise secured to the body 160. A third member or "cap member" 120 can be removably disposed about the inner member 130, adjacent the injection member 110. The cap member 120 can have a first surface 124 contacting one end of the injection member 110 and a second surface 125 disposed about an outer surface or diameter 132 of the inner member 130. As depicted in FIG. 1A, the first surface 124 of the cap member 120 can be used to seal off or block fluid communication to and from the chamber 155 via the port 115.

The cap member 120 can be radially fastened to the inner member 130 and/or axially fastened to the injection member 110 to hold the injection member 110 in place using one or more fasteners 131. Suitable fasteners 131 can include, but are not limited to, bolts, latches, screws, rivets, pins, threads, or combinations thereof. When fastened, the cap member 120 can be adapted to seal the port 115 and/or retain the outer member 110 against the screen 150.

Figure 1B:
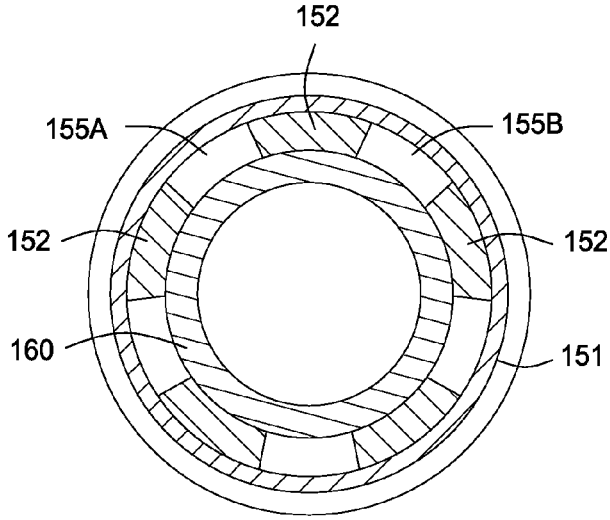
FIG. 1B depicts a cross-sectional view of the downhole screen assembly depicted in FIG. 1A along line 1B-1B.

FIG. 1B depicts a cross-sectional view of the downhole screen assembly 100 depicted in FIG. 1A along line 1B-1B. Referring to FIGS. 1A and 1B, the screen 150 can include at least two axially disposed wires or rods 152. A wire wrap or screen jacket 151 can be at least partially disposed about the axial wires 152 to enclose the chamber 155 and the outer surface 162 of the body 160. As depicted in the FIG. 1B, the chamber 155 can be two or more chambers 155A, 155B each defined between the axial wires 152 and the body 160.

Figure 2A:
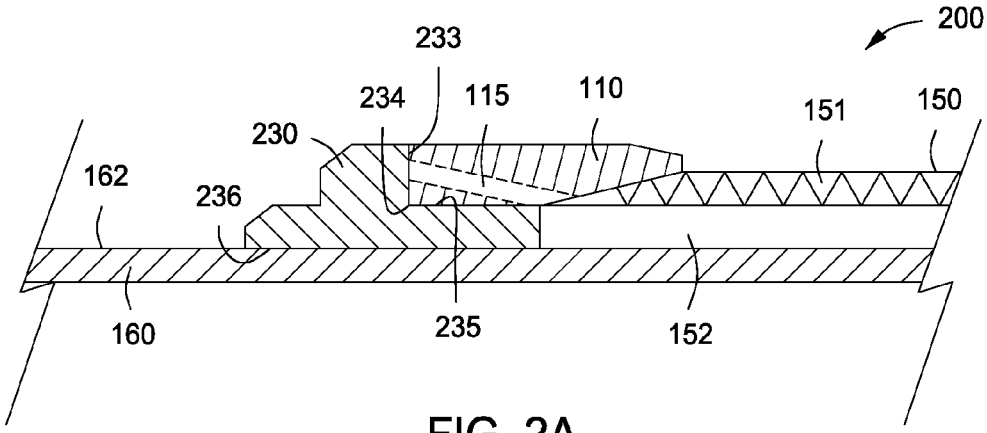
FIG. 2A depicts a partial cross-sectional view of another illustrative downhole screen assembly for dispensing a tracer material, according to one or more embodiments described.

FIG. 2A depicts a partial cross-sectional view of another illustrative downhole screen assembly 200 for dispensing a tracer material, according to one or more embodiments. Similar to the screen assembly 100, the screen assembly 200 can include a body 160, screen 150, and injection member 110. In this embodiment, however, the screen assembly 200 includes a unitary cap or outer member 230, instead of the separate cap member 120 and inner member 130 as depicted in FIG. 1.

The cap 230 can be at least partially disposed directly on the body 160, abutting one end of the injection member 110. One end of cap 230 can have a stepped profile resulting in two sections or portions thereof 233, 235 having different outer diameters providing a shoulder 234 therebetween. As such, the injection member 110 can be disposed about the portion or "second portion" 235, and abut the shoulder 234 at a first end thereof, allowing the portion or "first portion" 233 to seal off the port 115.

The cap 230 can be removably fastened to the body 160, the screen 150, and/or the outer member 110. For example, the cap 230 can have an inner surface or inner diameter 236 that is fastened to the outer diameter 162 of the body 160. In one embodiment, the cap 230 can be axially adjusted to move along the length of the body 160, thereby being able to compress the outer member 110 against the screen 150 and/or body 160. Although not shown, a portion of the body 160 can be threaded to threadably engage mating threads on the cap 230. Alternatively, the cap 230 and body 160 can have mating extensions and grooves to provide a ratcheting mechanism that allows axial movement in one direction but not the other.

Figure 2B:
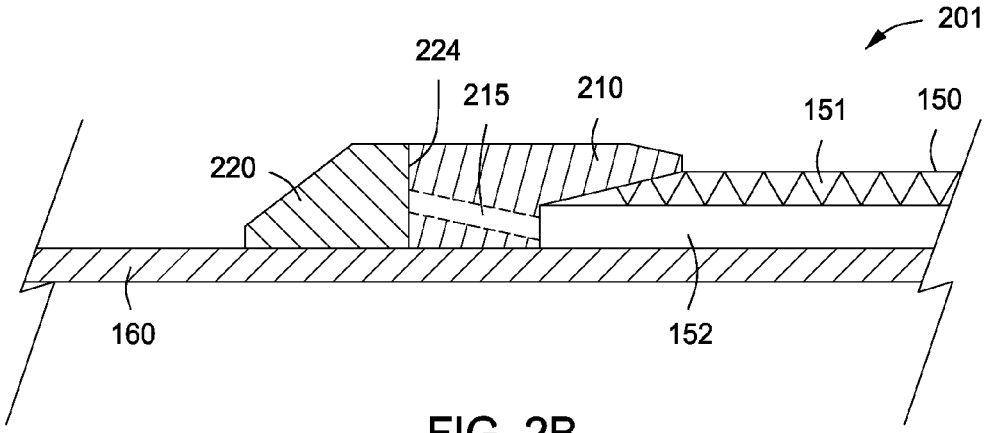
FIG. 2B depicts a partial cross-sectional view of yet another illustrative downhole screen assembly for dispensing a tracer material, according to one or more embodiments described.

FIG. 2B depicts a partial cross-sectional view of yet another illustrative downhole screen assembly 201 for dispensing a tracer material, according to one or more embodiments. The screen assembly 201 can include an injection member 210 having a first portion that is disposed directly about the body 160 and a second portion adjacent the screen 150. Similar to the injection member 110, the injection member 210 has one or more ports 215 disposed therethrough that can be in fluid communication with the chamber 155.

A cap member 220 can be removably disposed adjacent the injection member 210. The cap member 220 can be removably fastened to the body 160 and/or the injection member 210. The cap member 220 can be tightened to retain or compress the injection member 210 toward and/or against the screen 150 and/or the body 160, thereby sealing the port 215 with surface 224.

Referring to FIGS. 1A, 2A, and 2B, to fill the chamber 155 with a tracer material, the cap members 120, 220, 230 can first be removed to gain access to the port 115, 215, if not already removed. One or more tracer materials can be inserted through at least one of the ports 115, 215 of the injection members 110, 210, respectively, into the chamber 155. The tracer material can be inserted into the chamber 155 upstream of an inflow control device, or inserted into the chamber 155 downstream of an inflow control device.

Once the desired amount of tracer material(s) has been inserted, the cap member 120, 220, 230 can be attached or fastened to the assembly 100, 200, 201. The attached cap members 120, 220, 230 can then seal the port 115, 215, containing the tracer material in the chamber 155.

Although not shown, a portion of the body 160 can be threaded to threadably engage mating threads of any of the members 110, 130, 220, 230. Alternatively, the members 110, 130, 220, 230, and body 160 can have mating extensions and grooves to provide a ratcheting mechanism that allows axial movement in one direction but not the other. A member with such ratcheting mechanism is commonly referred to in the art as a "lock ring."

Figure 3A:
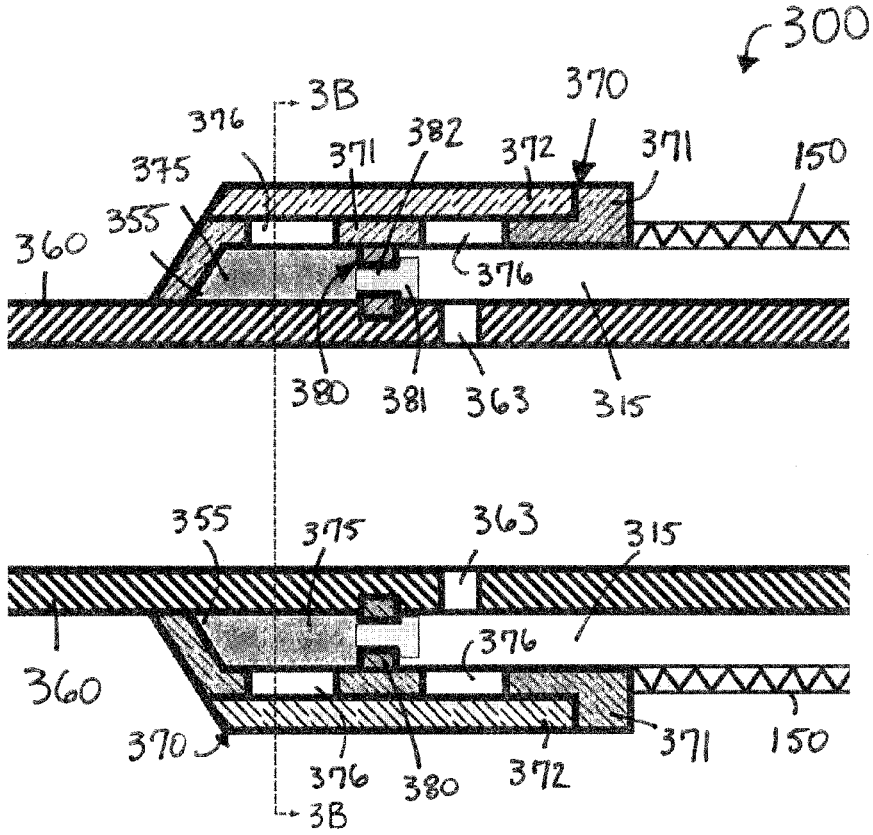
FIG. 3A depicts a cross-sectional view of yet another illustrative downhole screen assembly for dispensing a tracer material, according to one or more embodiments described.

FIG. 3A depicts a cross-sectional view of yet another illustrative downhole screen assembly 300 for dispensing a tracer material, according to one or more embodiments. The screen assembly 300 can include a body 360, housing 370, and screen 150. The housing 370 and the screen 150 can be disposed about the body 360, forming an annulus 315 therebetween. The body 360 can also have at least one nozzle or orifice 363 formed therethrough. The nozzle 363 can be or act as an inflow control device or injection control device ("ICD") that allows fluid communication between the annulus 315 and the bore of the body 360.

As an extension to the nozzle 363 acting as an ICD, one or more access ports 380 can provide a connection or communication between the annulus 315 and a chamber 355 in a first end of the housing 370. A chemical composition or material 375 can be housed or disposed in the chamber 355. The chemical composition or material 375 can include, but is not limited to, one or more tracer materials. One or more removable plugs 381 can be at least partially disposed within one or more orifices or holes 382 of the access port 380. In one embodiment, the plug 381 can be a dissolvable plug. For example, a plug 381 that is dissolvable can provide a barrier between the annulus 315 and the chamber 355 until the plug 381 is removed. Removing a plug 381 that is dissolvable can be accomplished, for example, by contacting the plug 381 with a treatment fluid such as an acid. In another embodiment, the screen assembly 300 can be installed without the plug 381 (not shown) to allow continuous fluid communication between the material 375, the annulus 315, and/or the nozzle 363.

The housing 370 can have an "inner portion" or base 371 and an outer cover 372. The base 371 can have one or more holes 376 disposed therethrough, wherein at least one of the holes 376 is in fluid communication with the chamber 355. The chamber 355 can be accessed via the hole(s) 376 disposed through the base 371 by removing the outer cover 372 of the housing 370. The outer cover 372 can seal the holes 376 of the base 371. The outer cover 372 can be fastened or otherwise secured onto the base 371 by a threaded connection, set screws, lock screws, a threaded lock ring or similar fastener, or a combination thereof (not shown).

Figure 3B:
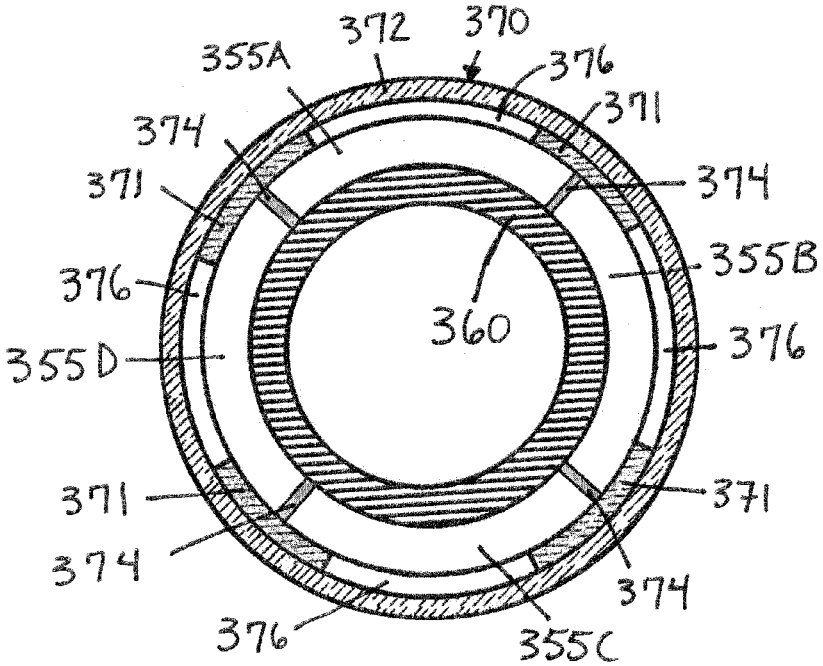
FIG. 3B depicts a cross-sectional view of the downhole screen assembly depicted in FIG. 3A along line 3B-3B.

FIG. 3B depicts a cross-sectional view of the illustrative downhole screen assembly 300 depicted in FIG. 3A along line 3B-3B. The chamber 355 in the housing 370 can be divided into a plurality of smaller sections 355A, 355B, 355C, and 355D by a plurality of walls 374 axially disposed therebetween. Each smaller section 355A-D can house the material 375 (not shown). The material 375 in each section 355A-D can be the same or different.

Referring to both FIGS. 3A and 3B, the access port(s) 380 can be used to control and/or regulate release of the material 375. The access port(s) 380 can delay release of the material 375 from the chamber 355. For example, when the plug 381 is a dissolvable plug, fluid communication can be triggered from the chamber 355 to the screen 150 and/or a flow path of injected or produced fluid by dissolving the plug 381. As such, the material 375 can be isolated until the plug 381 is removed. The material 375 can be activated just before the well is put in production. A treatment fluid, such as an acid, can be used to dissolve the plug 381 to provide access to the material 375. The plug 381 can be selectively dissolvable. For example, the rate of dissolution can vary among particular chemicals or chemical compositions. In this way, a plurality of trace readings can be made at various times and/or under varied well conditions. This method can also be used to place chemicals in the downhole screen assembly 300 for other than tracing purposes, such as for slow release or dissolution.

The nozzle 363, acting as an ICD, can provide a controlled pressure drop as fluid passes therethrough. Consequently, the fluid flow can have a preferred flow direction. As a result, material 375 can be located within the screen assembly 300 such that the material 375 is predominantly exposed to fluid coming from a limited section of the well, such as a downstream section of the well.

Figure 4A:
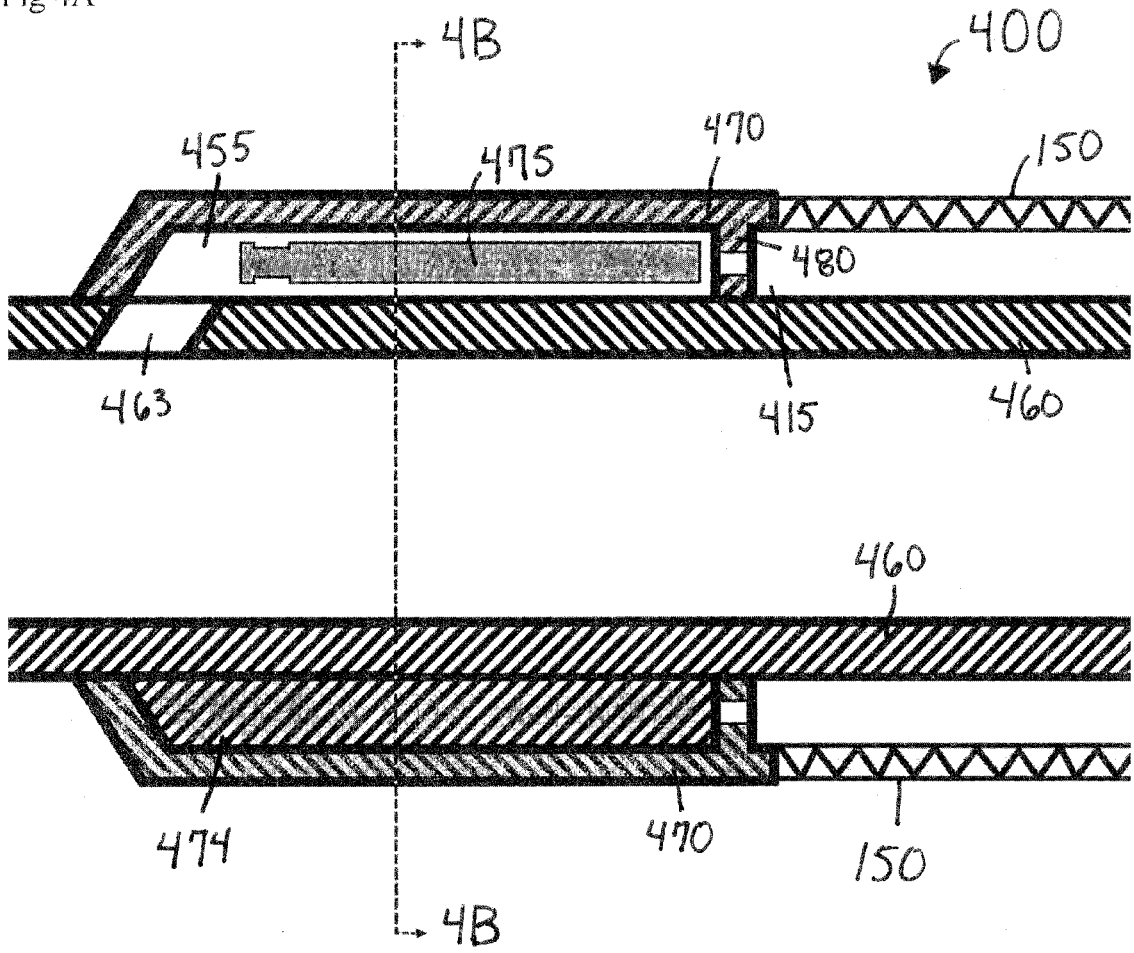
FIG. 4A depicts a cross-sectional view of yet another illustrative downhole screen assembly for dispensing a tracer material, according to one or more embodiments described.

FIG. 4A depicts a cross-sectional view of yet another illustrative downhole screen assembly 400 for dispensing a tracer material, according to one or more embodiments. Similar to the screen assembly 300, the screen assembly 400 can include a body 460, housing 470, and screen 150. The housing 470 and the screen 150 can be disposed about the body 460 forming an annulus 415 therebetween. The body 460 can have at least one nozzle or orifice 463 disposed therethrough acting as an ICD to allow fluid communication between the annulus 415 and the bore of the body 460.

At least one access port 480 can be disposed within the annulus 415, forming a chamber 455 in a first end of the housing 470 that can house a chemical composition or material 475. The chemical composition or material 475 can include, but is not limited to, one or more tracer materials. The access port 480 can be used to control and/or regulate fluid communication between the annulus 415 and the chamber 455. In one embodiment, the access port 480 can be one or more nozzles that can be oriented in the same plane as the material 475 or in a different plane. Flow within the screen assembly 400 can be guided parallel and with some distance from the material 475. Alternatively, high velocity or erosive flow can be guided in a path directly toward the material 475 to achieve erosion of material 475 and thereby increase or otherwise promote the release of the material 475. The nozzle 463 allows further fluid communication between the chamber 455 and the bore of the body 460.

Figure 4B:
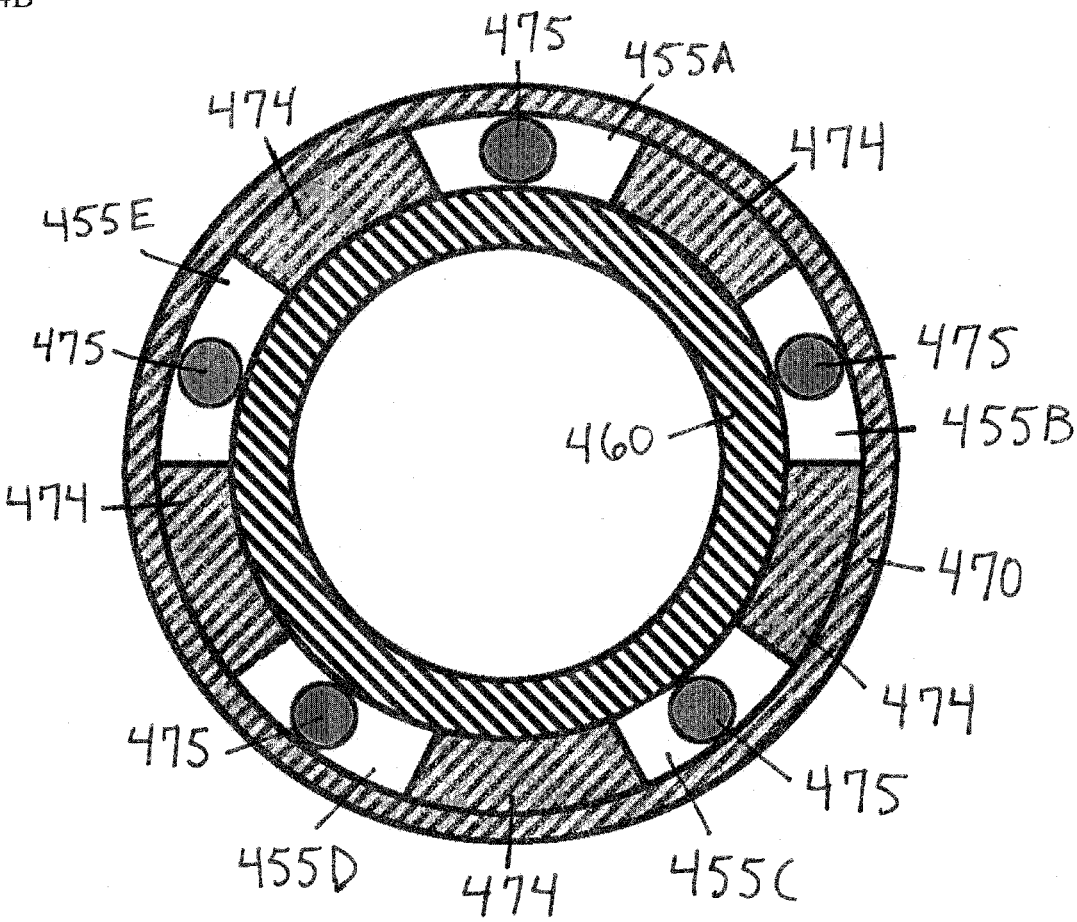
FIG. 4B depicts a cross-sectional view of the downhole screen assembly depicted in FIG. 4A along line 4B-4B.

FIG. 4B depicts a cross-sectional view of the downhole screen assembly 400 depicted in FIG. 4A along line 4B-4B. Referring to both FIGS. 4A and 4B, the chamber 455 in the housing 470 can be divided into a plurality of smaller sections 455A, 455B, 455C, 455D, and 455E by a plurality of walls 474 axially disposed therebetween. Each divided chamber 455A-E can house the material 475. The material 475 can be encapsulated in a matrix or particles, and can be shaped in rods or sticks of any geometric shape that can fit and/or be placed in the chamber 455. The material 475 retained in the chamber 455 can have a plurality of shapes, including, but not limited to, round, elliptical, uniform, non-uniform, square, rectangular, triangular, and any other shape. FIG. 4B depicts material 475 having round or elliptical cross-sections.

The material 475 and its matrix can be left inside the screen 150 and/or body 160 after the completion of the well. In one embodiment, the material 475 and its matrix can rest on the low side of the body 160, such as a base pipe, where it can be in contact with the fluids being injected or produced. As such, material 475 and its matrix can then be replaced from the surface.

Figure 5A:
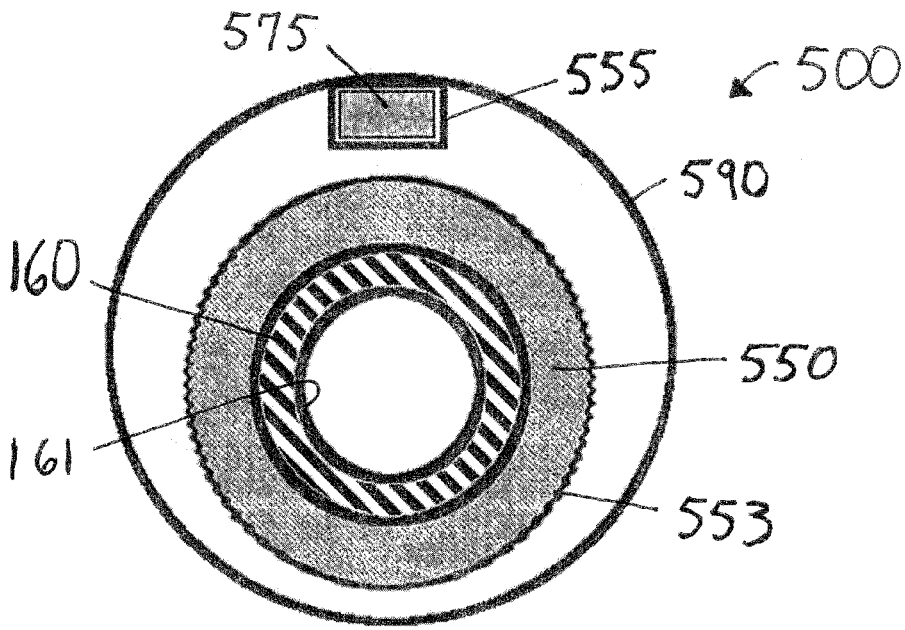
FIG. 5A depicts a cross-sectional view of yet another illustrative downhole screen assembly for dispensing a tracer material, according to one or more embodiments described.

FIG. 5A depicts a cross-sectional view of yet another illustrative downhole screen assembly 500 for dispensing a tracer material, according to one or more embodiments. The downhole screen assembly 500 can have an annular perforated shroud 590, a screen 550, and a channel 555 disposed about the body 160. The screen 550 can be eccentrically disposed in or through the shroud 590, and the shroud 590 can be fastened to an outer surface 553 of the screen 550.

In addition, the shroud 590 can have the channel 555 disposed therethrough so that both the channel 555 and the shroud 590 can be in fluid communication with the inner surface 161 of the body 160 through the screen 550. The channel 555 can be adapted to retain a chemical composition or material 575. The chemical composition or material 575 can include, but is not limited to, one or more tracer materials. In one embodiment, the channel 555 can be clamped to the screen 550. In another embodiment, the material 575 and its matrix, without the channel 555, can be clamped to the screen 550. In a further embodiment, the material 575, with or without the channel 555, can attach directly to the body 160.

Figure 5B:
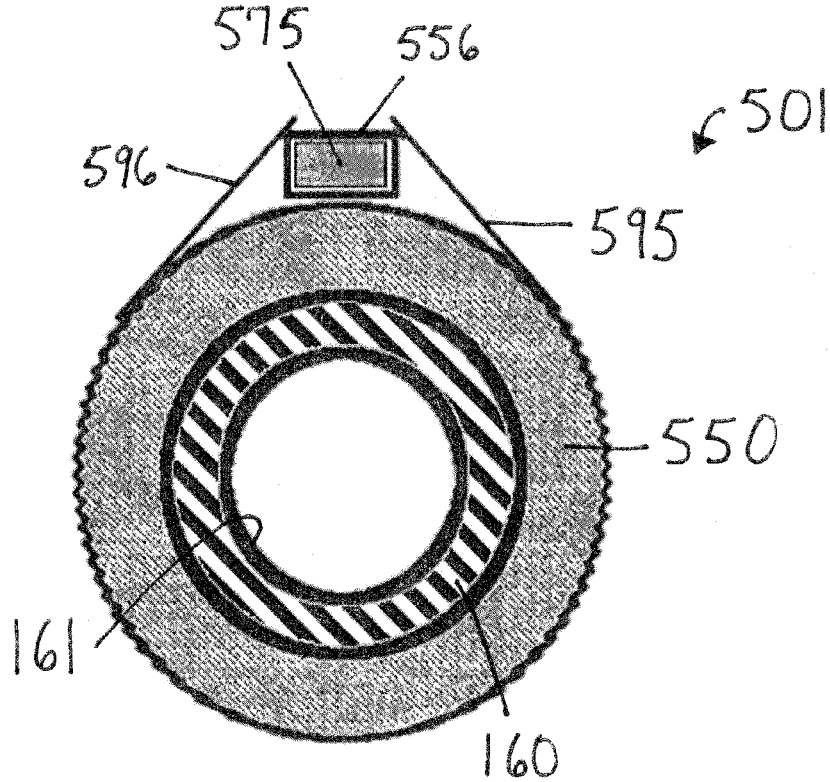
FIG. 5B depicts a cross-sectional view of yet another illustrative downhole screen assembly for dispensing a tracer material, according to one or more embodiments described.

FIG. 5B depicts a cross-sectional view of another illustrative downhole screen assembly 501 for dispensing a tracer material, according to one or more embodiments. In this embodiment, a channel 556 can be attached to the screen 550 using a first screen jacket 595 and a second screen jacket 596, rather than using a shroud. The channel 556 can be in fluid communication with the inner surface 161 of the body 160 through the annular screen 550 and can be adapted to retain the material 575. In one or more embodiments, the screen jackets 595, 596 can be directly attached to the material 575, such as when the material 575 has a matrix.

Figure 6A:
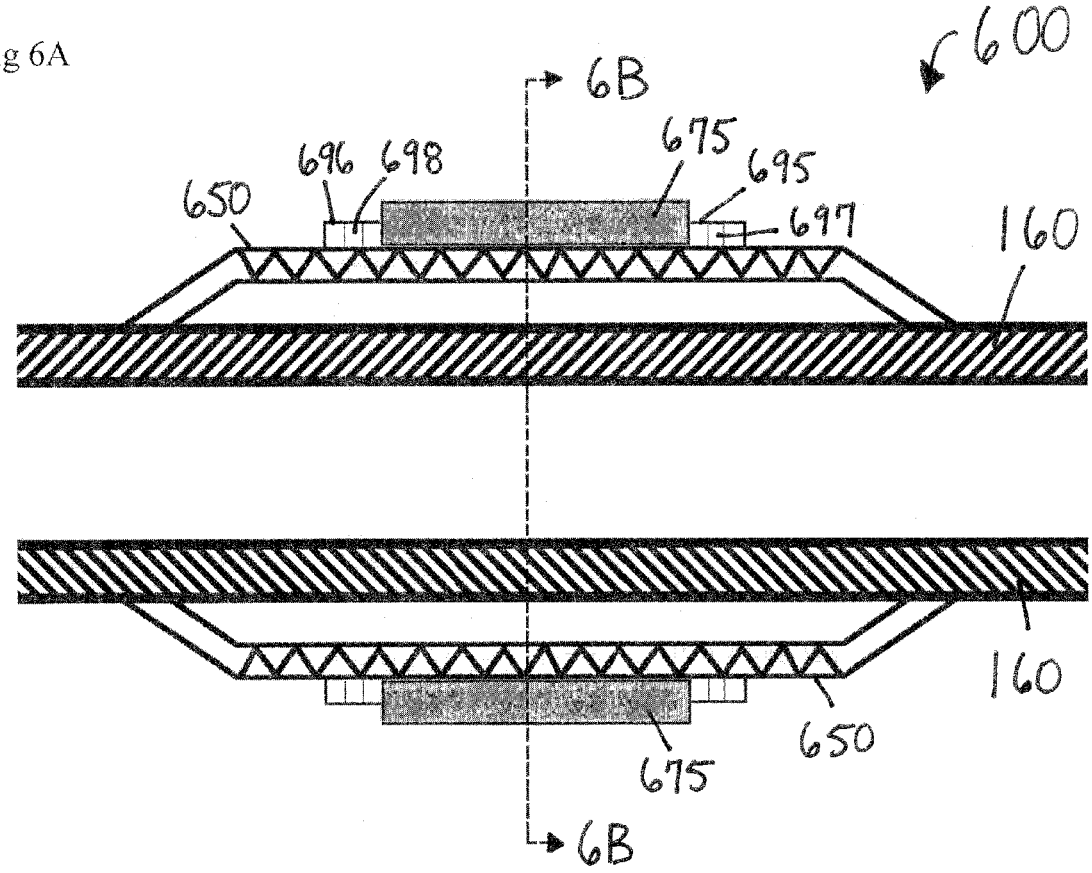
FIG. 6A depicts a cross-sectional view of another illustrative downhole screen assembly for dispensing a tracer material, according to one or more embodiments described.

FIG. 6A depicts a cross-sectional view of yet another illustrative downhole screen assembly 600 for dispensing a tracer material, according to one or more embodiments. The downhole screen assembly 600 can have a screen 650 disposed on the body 160. A chemical composition or material 675 can be attached to the screen 650. The chemical composition or material 675 can include, but is not limited to, one or more tracer materials. The material 675 can have a matrix that can help it keep a substantially rigid shape around the screen 650. A first annular stop collar 695 and a second annular stop collar 696 can fix or hold the material 675 in place. The stop collars 695, 696 can be fastened to the screen 650 using fastening members 697 and 698. In another embodiment, the stop collars 695, 696 can be joined to the screen 650 by at least one of a weld, rivet, screw, nail, glue, epoxy, or a combination thereof.

Figure 6B:
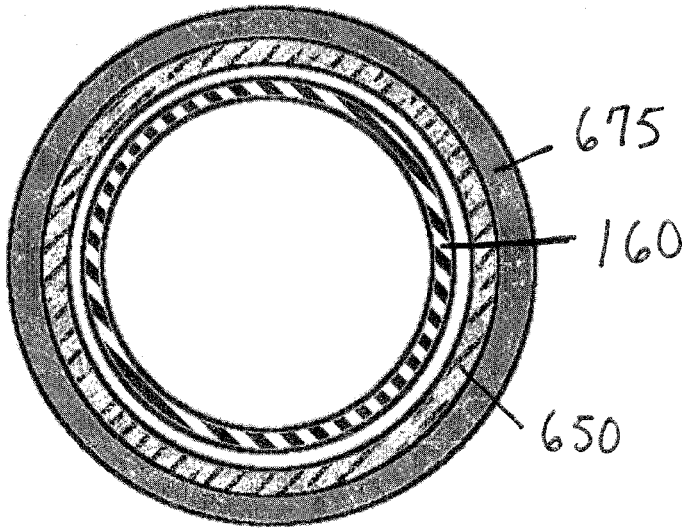
FIG. 6B depicts a cross-sectional view of the downhole screen assembly depicted in FIG. 6A along line 6B-6B.

FIG. 6B depicts a cross-sectional view of the downhole screen assembly 600 depicted in FIG. 6A along line 6B-6B. The material 675 disposed on the screen 650 can have an annular shape and can be in fluid communication with the screen 650 and the body 160. The material 675 with its matrix can be molded into a cylinder or sleeve that can be adapted to slide over the screen 650 or a screen jacket (not shown). The material 675 with its matrix can also be adapted to function both for release of the material 675 and as centralizer for the installation of screen 650.

As mentioned previously, the chemical composition or materials received by the chamber(s) 155, 355, 455, 555, 556 and/or the port(s) 115, 215, 315, 415 can be or include one or more tracer materials. The tracer material can have the form of a stick or other elongated, tubular structure that can be inserted under the screen jacket or wire wrap 151 of the screen 150. The tracer material can also be in the form of beads, powder, or paste that can be installed by gravity, with an air flow, and/or injected under the screen jacket or wire wrap 151. The tracer material or tracers can be radioactive or non-radioactive. The tracer material can also be perfluorinated hydrocarbons encapsulated in polymer matrices or particles. These matrices or particles can be sensitive to water and/or hydrocarbon, respectively. The polymer matrices can break and liberate the tracer by degradation. The tracer material can also be an oligonucleotide with special functional groups. The tracer materials can be fluorescent, phosphorescent, magnetic particles or fluids, colored particles, DNA or micro-organisms. Additionally, tracer material release can be triggered by oil, water, gas, or a combination thereof. The type and amount of tracer material can be varied by the type of fluid and/or gas that triggers the release, by the position of the tracer material in the completion, and by the geometric position around the wellbore, and can be varied from well to well.

In operation, the tracers or tracer material can be placed alongside the screen 150, under the screen 150, or adjacent the screen 150. The tracer material can be placed in front of the reservoir section of a well and in the flow path of the produced fluids in order to be released as per design. Placement of the tracer material in front of the reservoir section of a well and in the flow path of the produced fluid can facilitate allocation and/or identification of the produced fluids to a section of the wellbore and reservoir. The tracer or tracer material can be used to mark any type of produced or injected fluids.

Detection methods for detecting tracer material can take many forms. The detection methods can detect and/or identify different tracer materials present at a very low concentration in produced fluid coming out of the well. Detection methods can at least include optical, spectroscopic, chromatographic, acoustic, magnetic, capacitive, microwave techniques, or any combination of these techniques.

When tracers or tracer material are used with produced fluids, samples of the produced fluids can be taken on the surface to check the presence and the type of tracers or tracer material. The samples can be taken manually, detected through an automated process, or a combination thereof. The samples can be taken intermittently, continuously, or a combination thereof. The presence of tracers can be interpreted to determine what event or combination of events has occurred downhole. The information retrieved can be used to take actions on a particular well or to a particular field. The information retrieved can also be used to improve knowledge of the reservoir being produced and update a reservoir model or models.

Installation of the tracer material can be before or after manufacture of the screen 150. The installation and/or removal of tracer material in sand screens, such as the screen 150, can occur after the screen 150 has been installed downhole. For example, this method can be applied to install tracer material in a completion for the first time or to renew the tracer in an existing completion where the tracer material has been spent. The tracer material, with or without a matrix, can be injected downhole using coiled tubing, a packer combination, and/or a modified Modular Formation Dynamics Tester (MDT) tool. Packer elements can be arranged to a first side and a second side of at least one port 115 to give access to at least one chamber 155 alongside or under the screen 150. The tracer material can also be renewed and/or injected downhole through a chemical injection line that can be installed alongside the completion during a first installation. Thus, the tracer material and its matrix can be injected and/or removed during the life of the well.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A downhole screen assembly for dispensing a tracer material, comprising:

an annular body having a screen disposed thereabout;

a chamber disposed between the body and the screen;

a tracer material disposed within the chamber;

a first member disposed about the body, the first member having a port through which the tracer material is inserted into the chamber; and a second member disposed about the body and in contact with the first member such that the second member seals the port.

2. The downhole screen assembly of claim 1, further comprising a third member disposed about the body, wherein the first member and the second member are at least partially disposed on the third member.

3. The downhole screen assembly of claim 2, wherein at least one of the first member and the third member is welded to at least a portion of the screen.

4. The downhole screen assembly of claim 2, wherein the second member is fastened to the third member.

5. The downhole screen assembly of claim 2, wherein the second member is at least partially threaded onto the third member.

6. The downhole screen assembly of claim 1, wherein the second member is fastened to the first member.

7. The downhole screen assembly of claim 1, wherein the first member is at least partially disposed on the screen.

8. The downhole screen assembly of claim 1, wherein the screen comprises at least two axial wires and wrap wire at least partially disposed on the axial wires, and wherein the chamber is disposed between the at least two axial wires.

9. The downhole screen assembly of claim 1, wherein the tracer material is perfluorinated hydrocarbons encapsulated in a polymer matrix or polymer particles.

10. The downhole screen assembly of claim 1, wherein the downhole screen assembly is proximate an inflow control device.

11. A method of installing tracer material in sand screens, comprising:

accessing a downhole screen assembly, wherein the downhole screen assembly comprises:

an annular body having a screen disposed thereabout;

a chamber disposed between the body and the screen;

a first member disposed about the body, the first member having a port formed therethrough that is in fluid communication with the chamber; and a second member disposed about the body and in contact with the first member such that the second member seals the port;

removing the second member;

inserting a tracer material through the port into the chamber; and sealing the port by reattaching the second member.

12. The method of claim 11, wherein the inserting of the tracer material occurs after the screen has been manufactured and before the downhole screen assembly is installed in a well.

13. The method of claim 11, wherein the tracer material is inserted downhole.

14. The method of claim 11, wherein the tracer material is inserted into the chamber upstream of an inflow control device.

15. The method of claim 11, wherein the tracer material is inserted into the chamber downstream of an inflow control device.

16. A downhole screen assembly for dispensing a tracer material, comprising:

an annular body;

a screen disposed radially outward from the body, wherein a chamber is formed between the body and the screen;

a tracer material disposed within the chamber;

a first member disposed radially outward from the body, wherein the first member has a port through which the tracer material is inserted into the chamber;

a second member disposed radially outward from the body and in contact with the first member such that the second member seals the port; and a third member disposed between the body and the second member, wherein the second member is fastened to the first member, the third member, or both.

17. The downhole screen assembly of claim 16, wherein at least a portion of the screen is disposed between the first member and the chamber, and wherein the port is in fluid communication with the chamber through the screen.

18. The downhole screen assembly of claim 16, further comprising an axial rod disposed between the body and the screen, and wherein the rod is circumferentially offset from the tracer material.

19. The downhole screen assembly of claim 16, wherein at least a portion of the third member is disposed between the body and the first member.

20. The downhole screen assembly of claim 16, wherein the tracer material is perfluorinated hydrocarbons encapsulated in a polymer matrix or polymer particles.

* * * * *